US006496995B1

(12) United States Patent
Quinn

(10) Patent No.: US 6,496,995 B1
(45) Date of Patent: Dec. 24, 2002

(54) SYSTEM FOR SIMULATING A FOUR-POSTER

(76) Inventor: Carrie L. Quinn, 208 Palos Verdes Blvd. #2, Redondo Beach, CA (US) 90277

( * ) Notice: Subject to any disclaimer, the term of this patent is extended or adjusted under 35 U.S.C. 154(b) by 0 days.

(21) Appl. No.: 09/904,150

(22) Filed: Jul. 13, 2001

(51) Int. Cl.[7] ..... A47C 31/00
(52) U.S. Cl. ..... 5/658; 5/493
(58) Field of Search ..... 5/512, 493, 658

(56) References Cited

U.S. PATENT DOCUMENTS

D249,915 S * 10/1978 Vargas ..... D6/503
4,228,980 A * 10/1980 Beauchamp et al. ..... 16/87.2
4,295,482 A * 10/1981 McMullen ..... 135/120.3
4,354,091 A * 10/1982 Bain ..... 219/212
4,414,727 A * 11/1983 Steele ..... 29/401.1
4,729,137 A * 3/1988 Denney ..... 135/121
5,836,330 A * 11/1998 Franklin ..... 135/90

* cited by examiner

*Primary Examiner*—Thomas B. Will
*Assistant Examiner*—Tara L. Mayo
(74) *Attorney, Agent, or Firm*—Irving Keschner

(57) ABSTRACT

A system for converting a bed into a simulation of four-poster comprising an frame member having a rectangular shape comprising four rail members, each rail member being secured to the bedroom ceiling with fasteners above and parallel with the sides and ends of the bed. Each rail member has a recessed portion extending substantially around its periphery and an upper lip portion formed by the recess and extending around the periphery of each rail member forming the frame member. A first fastening system is applied to the surface of the lip portion of each rail member to couple a valance thereto and a second fastening system is applied to the surface of the recessed portion of each rail member to couple draperies thereto.

3 Claims, 6 Drawing Sheets

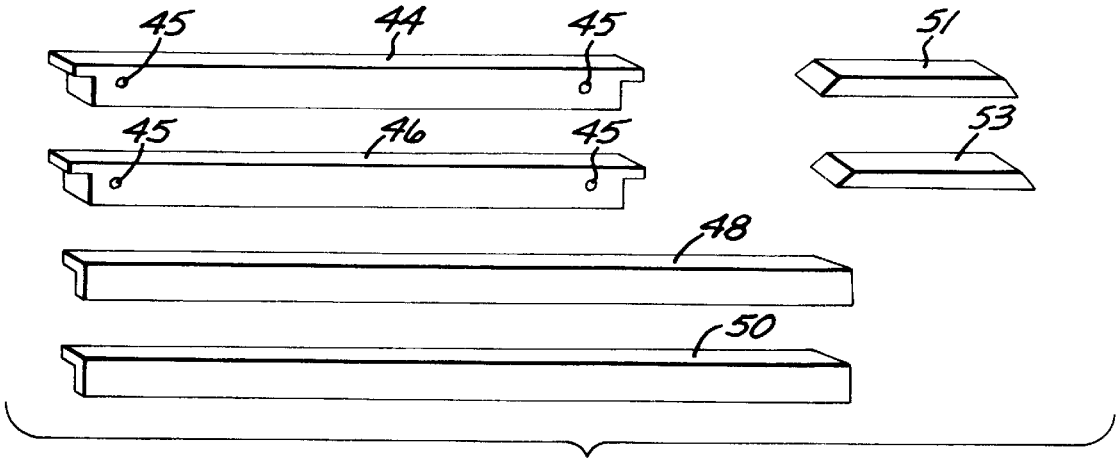
FIG. 9A
FIG. 9B
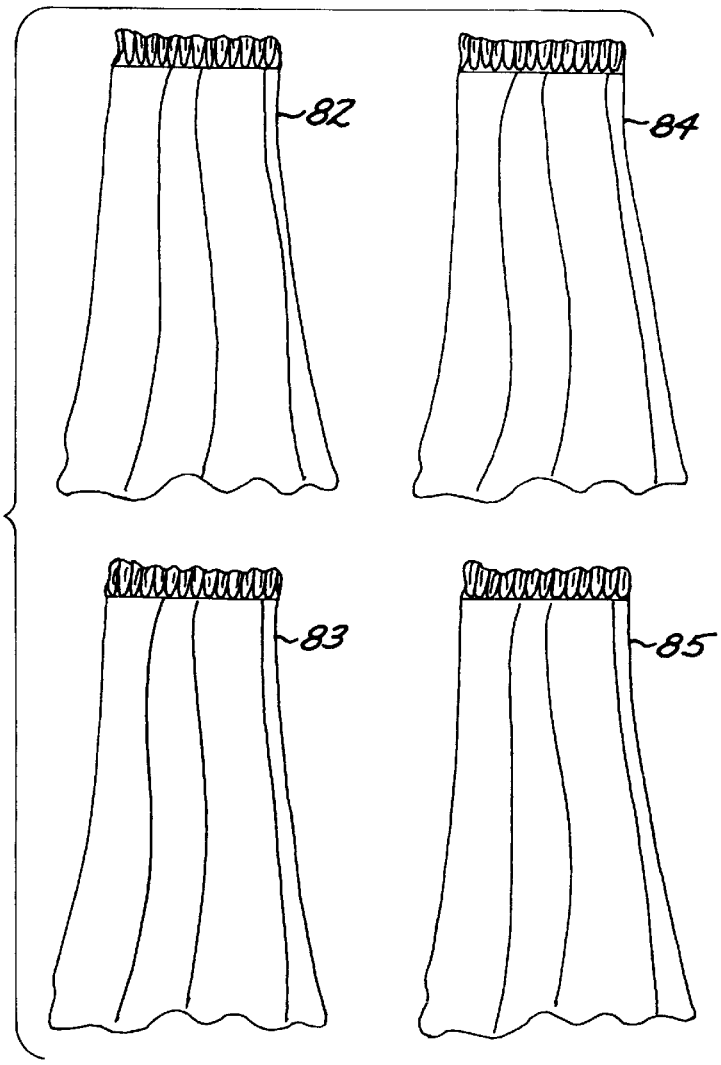

SYSTEM FOR SIMULATING A FOUR-POSTER

BACKGROUND OF THE INVENTION

1. Field of the Invention

The present invention provides a system which inexpensively simulates the look of a conventional four poster bed without using posts.

2. Description of the Prior Art

The conventional bedroom four-poster comprises a large sized bed, vertically extending posts positioned at the four corners of the bed, a support member coupled to the four top ends of each post and valances extending around the edges of the support member. Other four-posters include draperies positioned to decorate the posts.

Conventional four-posters, although desirable to many homeowners, can not be utilized in the bedrooms of typical residences, due to the size of the four-poster, and more importantly, the cost thereof U.S. Pat. No. 4,414,727 to Steele discloses a kit for converting a bed into a four-poster. The conversion kit includes four corner posts and means for securing pelmets above an associated corner of the bed. Although the kit described in the '727 patent allows a standard bed to be converted into a four-poster, the kit is complex to assemble and relatively expensive to purchase.

What is thus desired is to provide a bedroom arrangement which simulates a four-poster but is less expensive and relatively easy to assemble when compared to a conventional four-poster.

SUMMARY OF THE INVENTION

The present invention provides a system for converting an ordinary bed into a simulated four-poster and comprises an essentially rectangular shaped frame member, preferably comprising four separate rail members, each rail member secured to the bedroom ceiling with fasteners above and parallel with the sides and ends of the bed. Each rail member has a recessed portion extending substantially around its periphery and an upper lip portion formed above the recess and extending around the periphery of each rail member forming the frame member. A first fastening system is applied to the surface of the lip portion of each rail member to couple a valance thereto and a second fastening system is applied to the surface of the recessed portion of each rail member to couple draperies thereto.

The draperies and valances are provided in predetermined colors and styles and the customer can choose the desired combination in accordance with their design preferences.

The system is relatively inexpensive and easy to assemble and enables the homeowner to decorate his/her bedroom in a stylish manner, the bed giving the visual impression of a four-poster without the cost normally associated therewith. The frame member can be easily disassembled and the system reutilized in a different residence or another room of the same residence if so desired. The valances/draperies are easily removable and interchangeable with other sets of valances/draperies made of different fabric and variable colors.

DESCRIPTION OF DRAWING

For a better understanding of the present invention as well as other objects and further features thereof, reference is made to the following description which is to be read in conjunction with the accompanying drawing therein.

DESCRIPTION OF THE INVENTION

Figure 1:
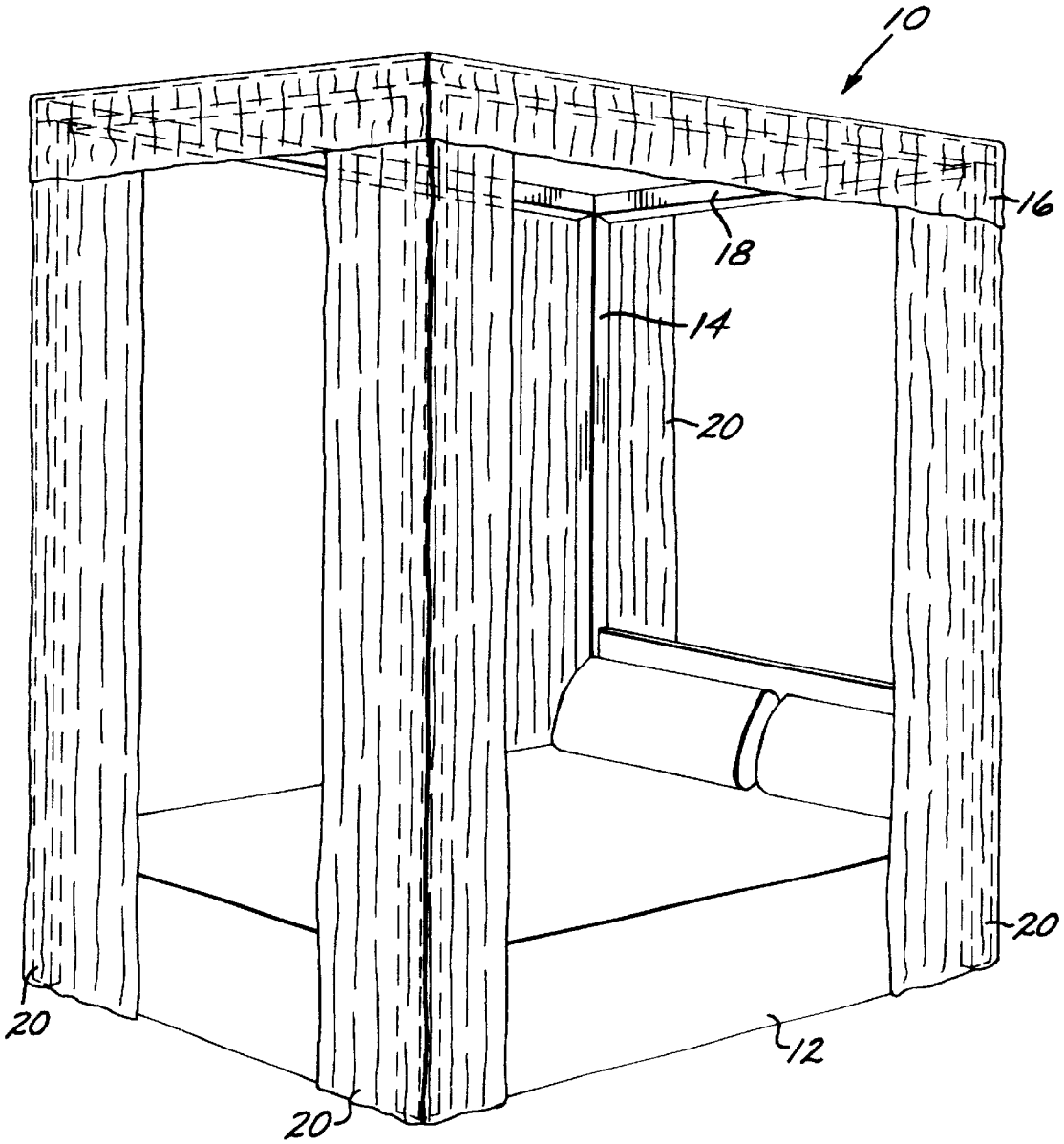
FIG. 1 PRIOR ART
FIG. 1 is a perspective view of a conventional four-poster.

Referring now to FIG. 1, a conventional four-poster bed arrangement 10 is illustrated. The bed 12 has four vertically extending posts positioned at each bed end (only one post 14 is illustrated). A valance 16 is connected to an upper frame member 18 and a series of four drapes, or curtains, 20 are positioned at the bed corners to cover and decorate the adjacent posts 14.

Figure 2:
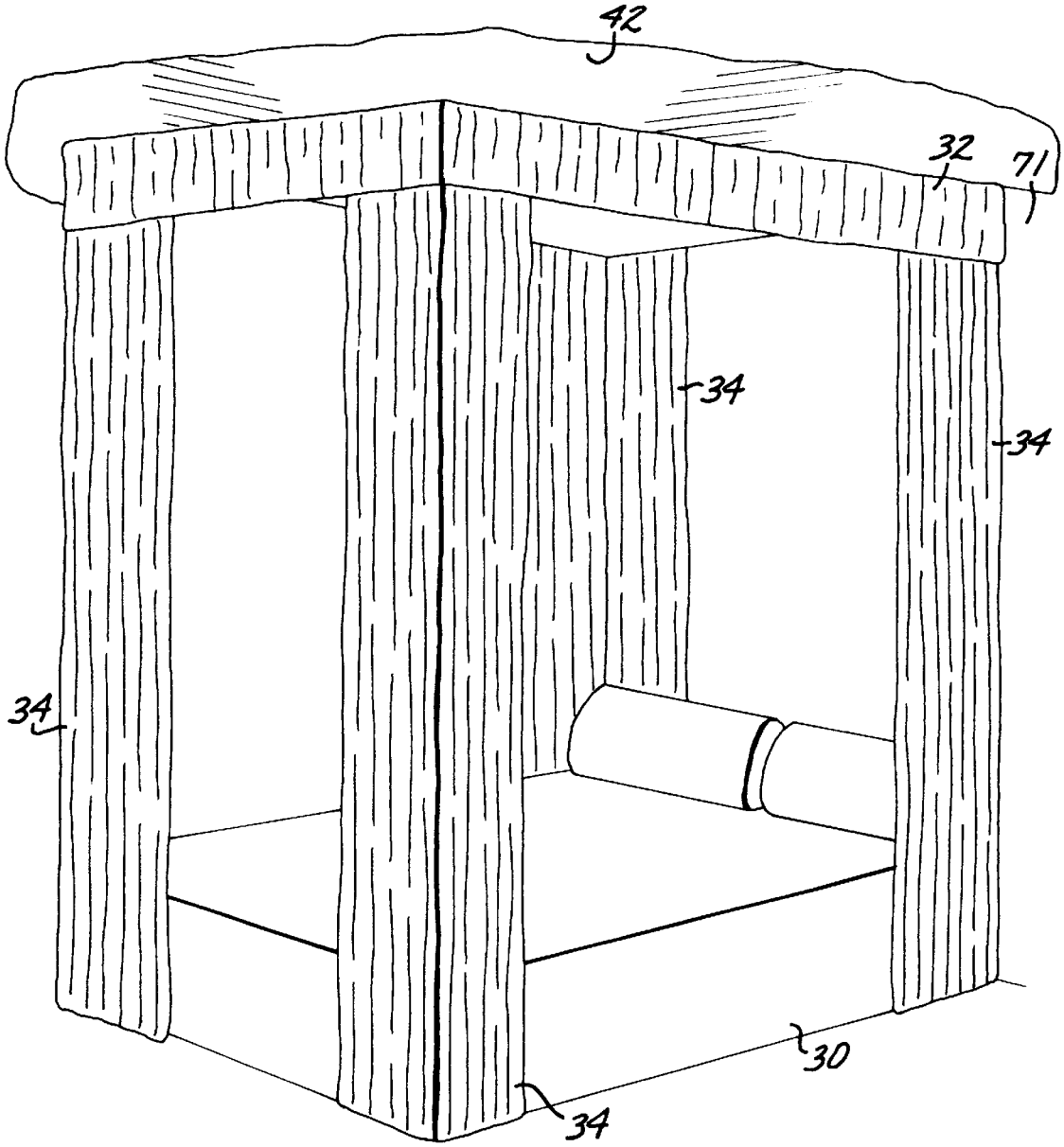
FIG. 2 is a perspective view of the simulated four-poster of the present invention.

In accordance with the teachings of the present invention, the same look as that shown in FIG. 1 is provided without the four vertically extending posts conventionally used as shown in FIG. 2. The simulated four-poster comprises bed 30, valances 32 and drapes 34. As will be set forth in more detail hereinafter, a frame member 40 (FIG. 3) is secured to ceiling 42 with valances 32 and drapes 34 joined to frame member 40.

Figure 3:
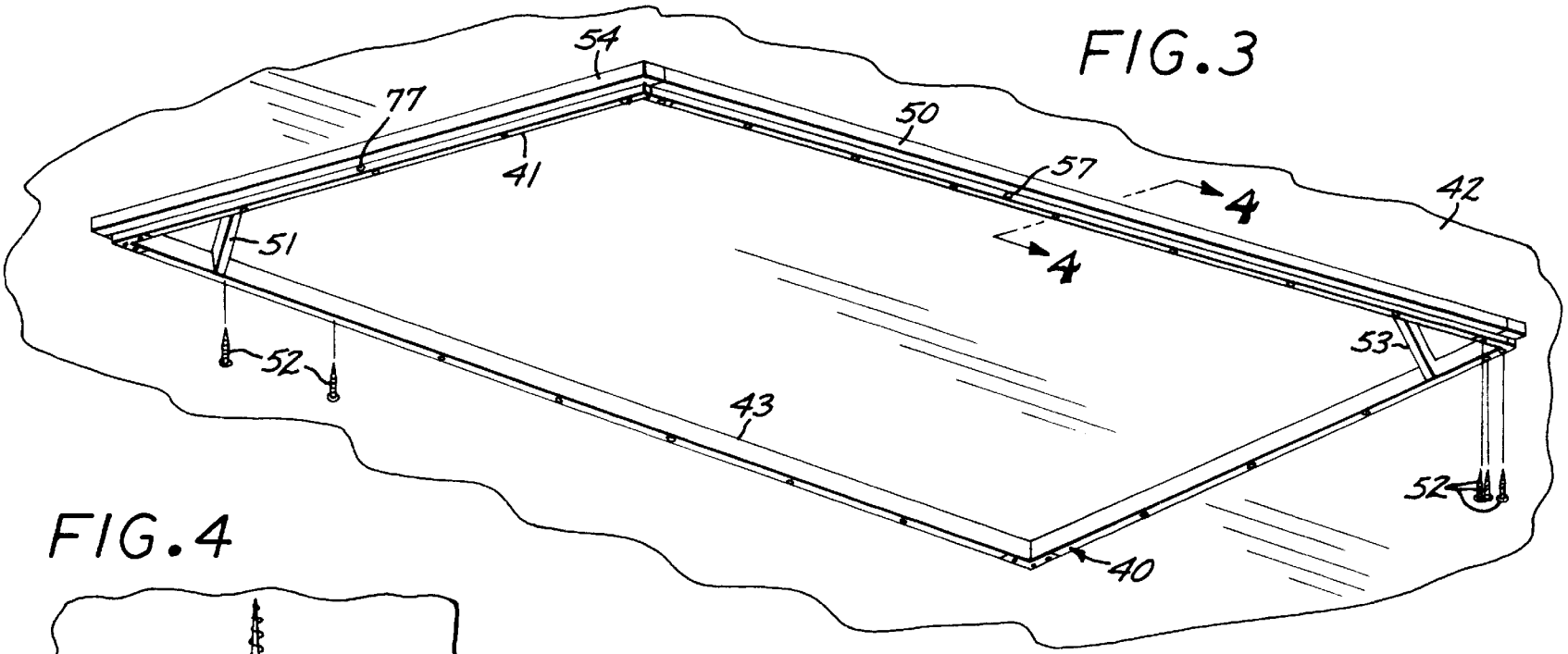
FIG. 3 illustrates the frame member portion of the present invention.
Figure 5:
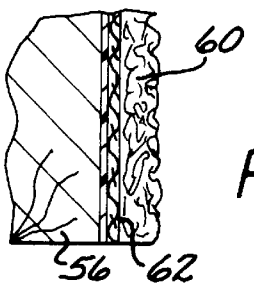
FIG. 5 is a detail of a portion of FIG. 4.
Figure 4:
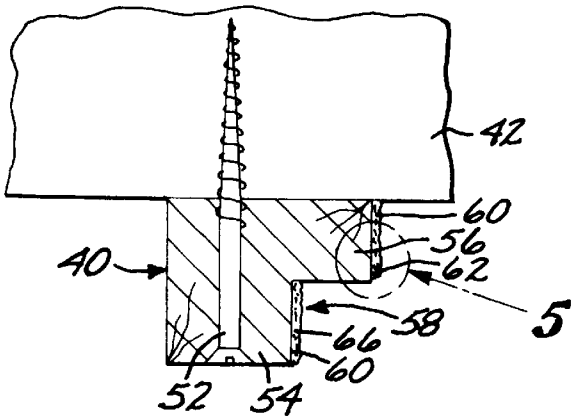
FIG. 4 is a cross-section along line 4—4 of FIG. 3.

Referring now to FIGS. 3 through 5, frame member 40, preferably made of four joined pieces of wood (a single, integral wood frame can also be utilized), is square or rectangle in shape (depending upon the size of bed 30) and sized to somewhat overlap the size of the bed positioned there below. Frame member 40 comprises head rail 44, foot rail 46, and side rails 48 and 50. The frame can be made of other materials, such as plastic. As illustrated, frame member 40 is secured to ceiling 42 using a plurality of fastening screws 52. Each rail member which comprises frame member 40 is L-shaped, having leg portions 54 and 56 forming a recessed portion 58, the recessed portions of each rail member, when joined together, extending around the periphery of frame member 40. The surfaces of leg portions 54 and 56 facing away from the bed 30 as illustrated, in the preferred embodiment, has one part 60 of a VELCRO® fastening system secured thereto, such as the VELCRO loops (VELCRO is a trademark of VELCRO Industries, for a hook-and-loop fastener). As will be set forth in more detail hereinafter, loops 60 formed on surface 62 of leg portion 56 of leg portion 56 are adapted to receive the hook portions of the VELCRO fastener formed on valances 32; loops 60 formed on surface 66 of the leg portion 54 are adapted to receive the hook portion of the VELCRO fastener attached to the drapes 34.

Figure 6:
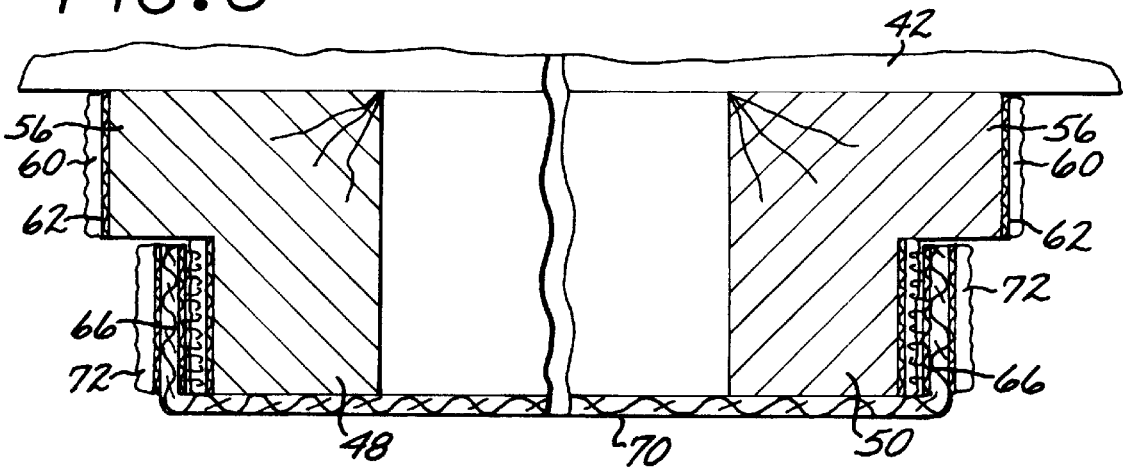
FIG. 6 is a sectional view showing the frame member of FIG. 2 with one portion of a fastening system secured thereto.
Figure 7:
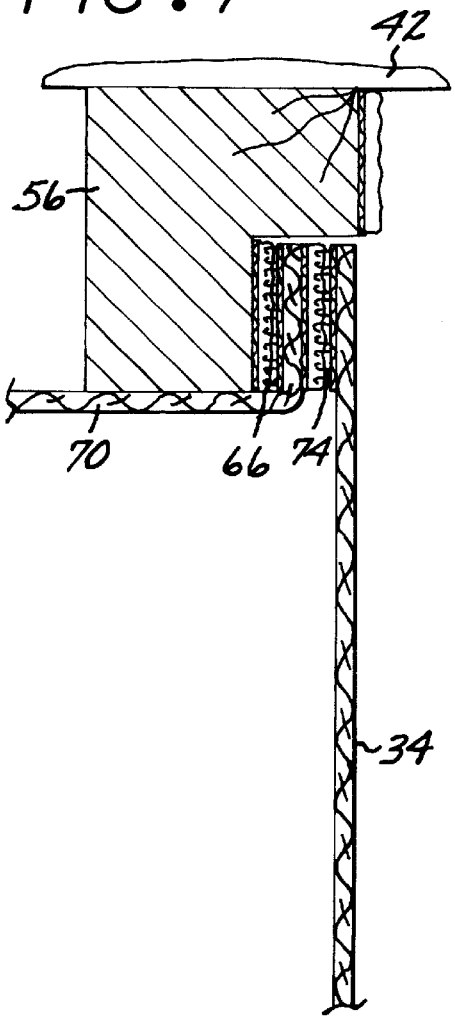
FIG. 7 illustrates draperies attached to the frame member.
Figure 8:
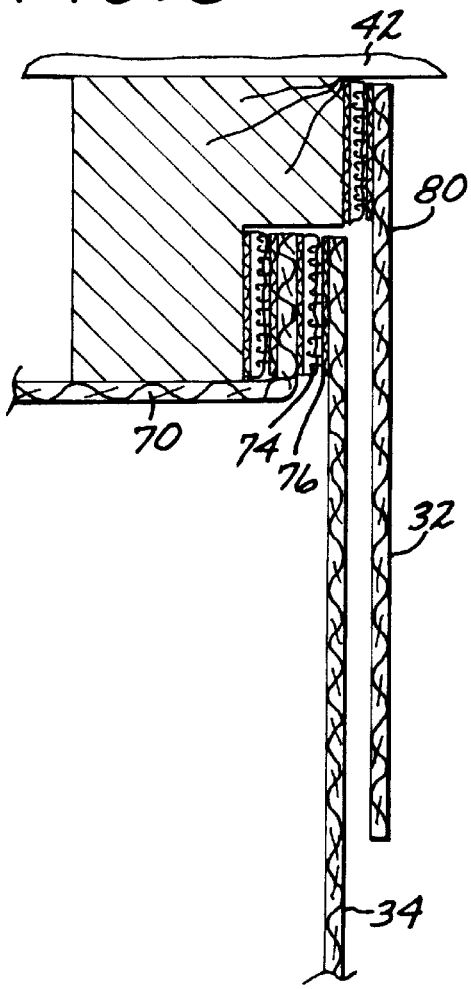
FIG. 8 illustrates valances attached to the arrangement shown in FIG. 7.

FIG. 6 illustrates side rails 48 and 50 of frame member 40 in more detail prior to the addition of valences 32 and drapes 34. It is noted that the same reference numerals in the figures refer to identical components. A ceiling panel, or cover, 70, having one component of the VELCRO fastener system 72 sewn thereto is provided for both decorative purposes (the person lying on the bed sees the panel 70, not the wood frame member 40) and to provide the fastening surface to secure draperies 34 thereto. The inner surface of the panel edge is joined to VELCRO fastener 66 as illustrated. The corner surface of panel 70 having a VELCRO component 74 secured thereto which is joined to VELCRO portion 66. Drapes 34 have a second fastening VELCRO component 76 attached thereto, such as by sewing, whereby drapes 34 are secured to the outer VELCRO surface of panel 70, the drapes thus in turn being secured to frame member 40 as shown in FIG. 7. As shown in FIG. 8, valances 32 have the second VELCRO fastener 80 attached thereto, such as by sewing to secure valances 32 to frame member 40.

Figure 9C:
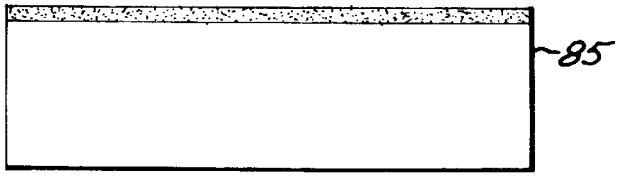
FIGS. 9(*a*)–9(*e*) illustrate the detailed steps to assemble the system of the present invention.
Figure 9D:
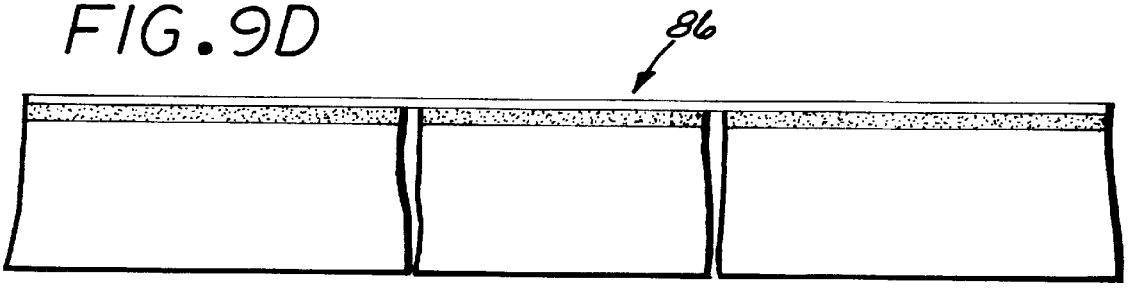
Figure 9E:
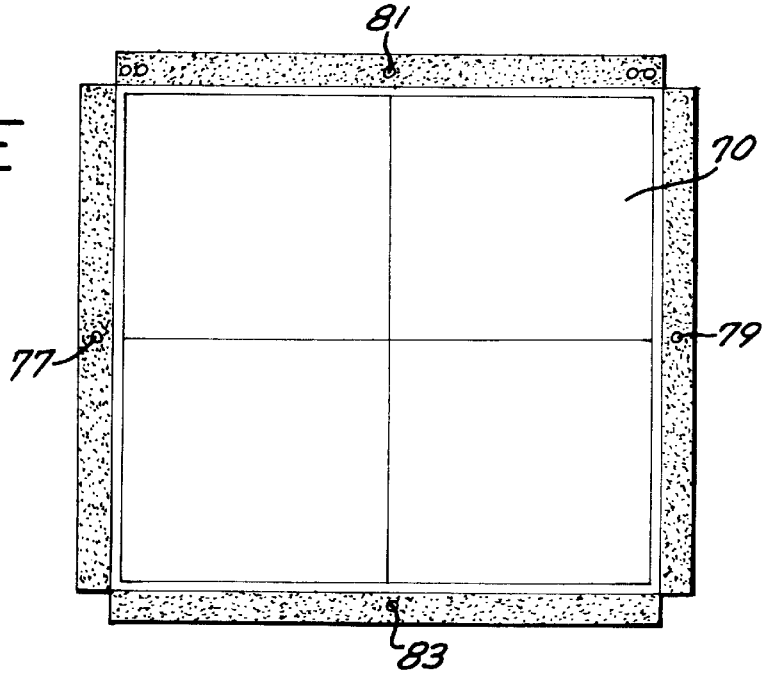

A detailed description of how the components of the system of the present invention are assembled is described hereinafter with reference to FIGS. 9(*a*)–9(*e*).

1. Frame member 40 is assembled by joining together rail members 44, 46, 48 and 50 using predrilled holes 45 formed on head rail 44 and foot rail 46 with fastening screws 52. Corner brackets 51 and 53 are attached to maintain the shape of frame member 40.

2. Frame member 40 is then lifted and centered over bed 30. An approximately one half inch gap is maintained between head rail 44 and wall 71 to allow room for attaching the valances 32 and draperies 34. Frame member 40 is then attached to ceiling 42 using screws 52.

3. The head valance 85 (FIG. 9(*c*)) is next attached to the top lip of the head rail 44, the VELCRO on head valance 85 being aligned with the VELCRO on head rail 44 and then being firmly pressed into place.

4. One side of the ceiling panel 70 (FIG. 9(*e*)) is then positioned adjacent the surface of head rail 44 having VELCRO secured thereto. From the center of the lower notched portion of head rail 44, the fabric side is first snapped to frame member 40 using snap members 77 (FIG. 3) and then the VELCRO fastening members are attached, the fabric being stretched tight as it is stretched the length of head rail 44

5. The snap 79 on ceiling panel 70 is located and then starting at the center of foot rail 46, ceiling panel fabric is stretched and snap 79 is attached to the corresponding snap 79 on frame member 40 (not shown in FIG. 3). Working from the center of foot rail 46, the fabric is pulled taught as the VELCRO fastener is attached to the corresponding VELCRO fastener attached to foot rail 46 along the length of foot rail 46.

6. The snap 81 on ceiling panel 70 is then located. Starting at the center of side rail 48, the ceiling panel fabric is stretched and snap 81 is attached to the corresponding snap on frame member 40 (not shown in FIG. 3). From the center of rail member 48, the ceiling panel fabric is stretched taut and the VELCRO fastener on ceiling panel 70 is attached to the corresponding VELCRO fastener attached to rail member 48 of frame member 40.

7. The snap 83 on ceiling panel 70 is then located. Starting at the center of side rail 50, the ceiling panel fabric is stretched and snap 83 is attached to corresponding snap portion 87 on frame member 40 (FIG. 3). From the center of rail member 50, the ceiling panel fabric is stretched taut and the VELCRO fastener on ceiling panel 70 is attached to the corresponding VELCRO fastener attached to rail member 50 of frame member 40.

8. The four side panels 82, 83, 84 and 85 each are attached at the four corners of bed 30. With an appropriate marker, the side panel VELCRO portions are pressed firmly into place with the VELCRO portion secured to the lower notched portion at the butting edges of the rail members.

9. Starting at wall 71, valance 86 is attached on the top piece of the VELCRO portion formed on the lip portions of rails 46, 48 and 50. The conventional welt at the top of the valance is rolled up against ceiling 42 and is adjusted to hide any discrepancies in the ceiling 42.

It should be recognized that other systems can be used to secure the valances and draperies to frame member 40, including, but not limited to, adhesives, buttons, sewing, etc. and that various fasteners can be used to secure the frame member 40 to the ceiling 42. As envisioned, the frame member 40 and the screws 52 used to fasten the frame member 40 to the ceiling 42 may be sold as a kit and the valances, draperies and cover 70 as separate accessories. Alternately, a retail center can have all the components of the system available for purchase with instructions on how to assemble the components to form the four-poster according to the teachings of the present invention.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A system for simulating a four-poster in the bedroom of a dwelling, the dwelling having a bed, ceiling and at least one wall, comprising:

a frame member comprising four rail members, the dimensions of said frame member corresponding to said bed; said rail members each having one surface with a notch formed therein, said notch extending along substantially the entire length of each of said rail members;

fastening members for securing said frame member to said ceiling;

first fastening means formed on said notched surface of each of said rail members;

second fastening means formed on the surface of each of said rail members above said notch; and a ceiling panel having a first edge portion, third fastening means being formed on at least a portion of one surface of said first edge portion, the other surface of said first edge portion having a fourth fastening means formed thereon.

2. The system of claim 1 further including a first fabric material having fifth fastening means secured along one edge thereof, said first fabric material being coupled to said fourth fastening means formed on said notched surface of said rail members.

3. The system of claim 2 further including a second fabric material having sixth fastening means secured along one edge thereof, said second fabric material being coupled to said second fastening means formed on said surface above said notched surface of said rail members.

* * * * *